US007258374B2

(12) United States Patent
Rusiana

(10) Patent No.: US 7,258,374 B2
(45) Date of Patent: Aug. 21, 2007

(54) LOW PROFILE PUSH/PULL DOOR LATCH ASSEMBLY

(75) Inventor: Arturo D. Rusiana, Algonquin, IL (US)

(73) Assignee: Architectural Builders Hardware Mfg., Inc., Itasca, IL (US)

( * ) Notice: Subject to any disclaimer, the term of this patent is extended or adjusted under 35 U.S.C. 154(b) by 99 days.

(21) Appl. No.: 11/131,967

(22) Filed: May 18, 2005

(65) Prior Publication Data

US 2006/0261608 A1 Nov. 23, 2006

(51) Int. Cl.
*E05B 3/00* (2006.01)
*E05B 65/10* (2006.01)

(52) U.S. Cl. ..... 292/336.3; 292/92; 292/244

(58) Field of Classification Search ..... 292/336.3, 292/347–348, 173, 92, DIG. 46, 165, DIG. 31, 292/DIG. 56
See application file for complete search history.

(56) References Cited

U.S. PATENT DOCUMENTS 2,108,359 A * 2/1938 Accardi ..... 292/34
3,214,947 A * 11/1965 Wikkerink ..... 70/92
4,003,593 A 1/1977 Wilzig et al.
4,007,954 A * 2/1977 Erickson ..... 292/165
4,906,034 A * 3/1990 Verslycken ..... 292/92
4,986,583 A * 1/1991 Campbell et al. ..... 292/336.3
5,085,474 A 2/1992 Toledo et al.
5,403,047 A * 4/1995 Walls ..... 292/173
5,730,478 A 3/1998 D'Hooge
6,196,599 B1 * 3/2001 D'Hooge ..... 292/165
2004/0227351 A1 * 11/2004 Lin ..... 292/92

* cited by examiner

*Primary Examiner*—Brian E. Glessner
*Assistant Examiner*—Alyson Merlino
(74) *Attorney, Agent, or Firm*—Greer, Burns & Crain, Ltd

(57) ABSTRACT

A push/pull door latch assembly for use in a door includes a handle assembly and a latch cylinder. The handle assembly has a stop configured for limiting the movement of the handle during the push or pull operation, and absorbing shock transmitted from a user's hand through the handle and a cam assembly that operates in response to the push or pull operation of the handle. The cam assembly operates the latch so as to unlock the door when the handle is pushed or pulled.

20 Claims, 3 Drawing Sheets

LOW PROFILE PUSH/PULL DOOR LATCH ASSEMBLY

BACKGROUND OF THE INVENTION

The present invention relates to door latch assemblies, and more particularly, to push and pull door latch assemblies that are typically used in hospitals and other facilities where it is desirable to be able to unlatch and open a door in one motion by pulling or pushing a handle in the latch assembly.

Push/pull type door latch assemblies are known in the art, and enable the user to easily open a door with one hand. These types of door handles enable a door to be opened inwardly into a room by pushing on an outside handle or pulling on an inside handle. Because no rotational movement is required to operate the handles, as is the case with conventional doorknobs, push/pull door latch assemblies are commonly used in hospitals and other institutions, and can be easily used in an emergency by the disabled or by young children.

In current applications, a pull handle of a door latch assembly is mounted on the side of the door toward which the door opens and a push handle of the door latch assembly is mounted on the opposite side thereof. These assemblies typically incorporate a cam which causes the pushing or pulling movement of the handle to rotate an elongate key extending perpendicularly through an opening in a latch cylinder. When rotated, the elongate key withdraws the door latch to release the door. Generally, only a small amount of force in one direction is sufficient to release the latch.

However, because of the generally high-traffic, high-pressure atmosphere in hospitals and the like, both the cam and the handle can become worn down and damaged due to repeated use of the assembly. Every time the door latch assembly is operated, the cam experiences a shock due to the pushing or pulling of the handle, which wears down the cam, particularly when the shock is excessive, as can happen in emergency situations. As either the cam or the handle become worn down, it can become more difficult for a user to push or pull on the door handle, which can lead to dangerous consequences in an emergency situation. These instances reduce the life of the apparatus and require replacement.

Therefore, there exists a need to better protect latch assemblies from the shock experienced during operation of the push/pull door latch assembly, thereby increasing the life of the assembly. There also exists a need to reduce the wear on the latch assembly, so that the ease of operating the push/pull handle remains consistent and reliable despite repeated use.

BRIEF SUMMARY OF THE INVENTION

The above-listed objects are met or exceeded by the present push/pull door latch assembly, which features a stop that is configured to reduce the shock experienced by the cam during operation of the door assembly. The stop reduces the wear on both the cam and the handle, increasing the life of the door latch assembly.

More specifically, the present invention provides a push/pull door latch assembly for use in a door, including a handle assembly and a latch cylinder, the latch cylinder including a latch, and the handle assembly including a mounting plate having a pair of sidewalls, a handle secured between the sidewalls for a push or pull operation, a stop configured for limiting the movement of the handle during the push or pull operation, and a cam assembly operating in response to the push or pull operation of the handle, the cam assembly operating the latch so as to unlock the door when the handle is pushed or pulled.

DETAILED DESCRIPTION OF THE INVENTION

Figure 1:
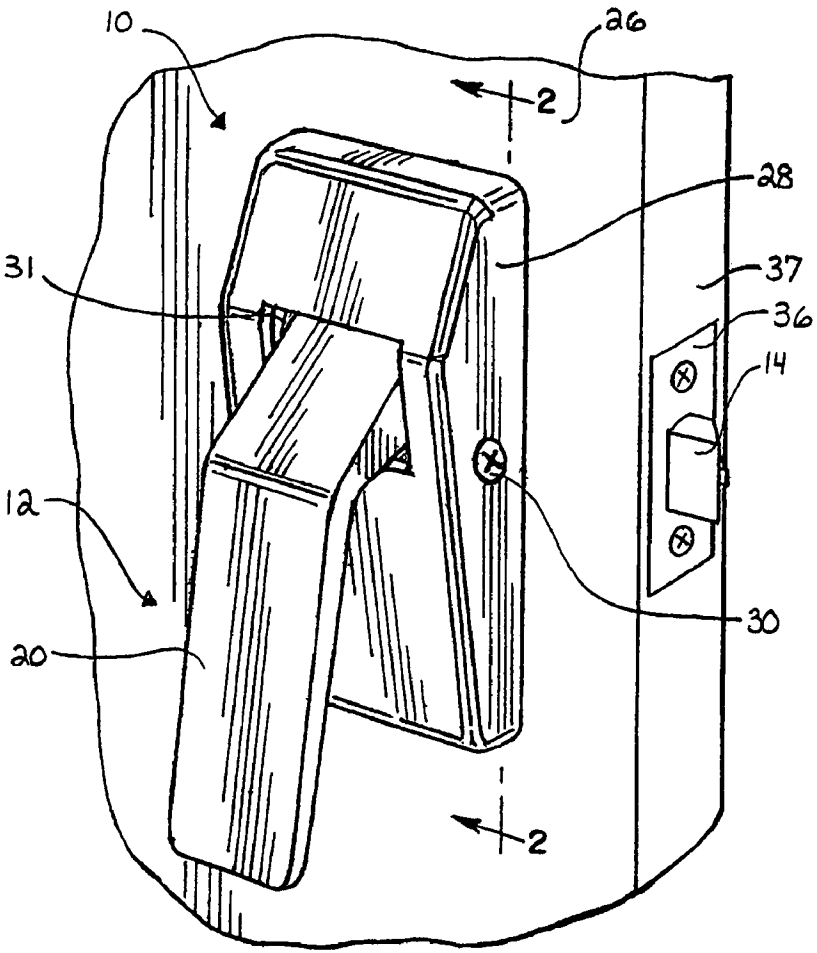
FIG. 1 is a perspective view of one embodiment of the present push/pull door latch assembly as it appears in a door.
Figure 3:
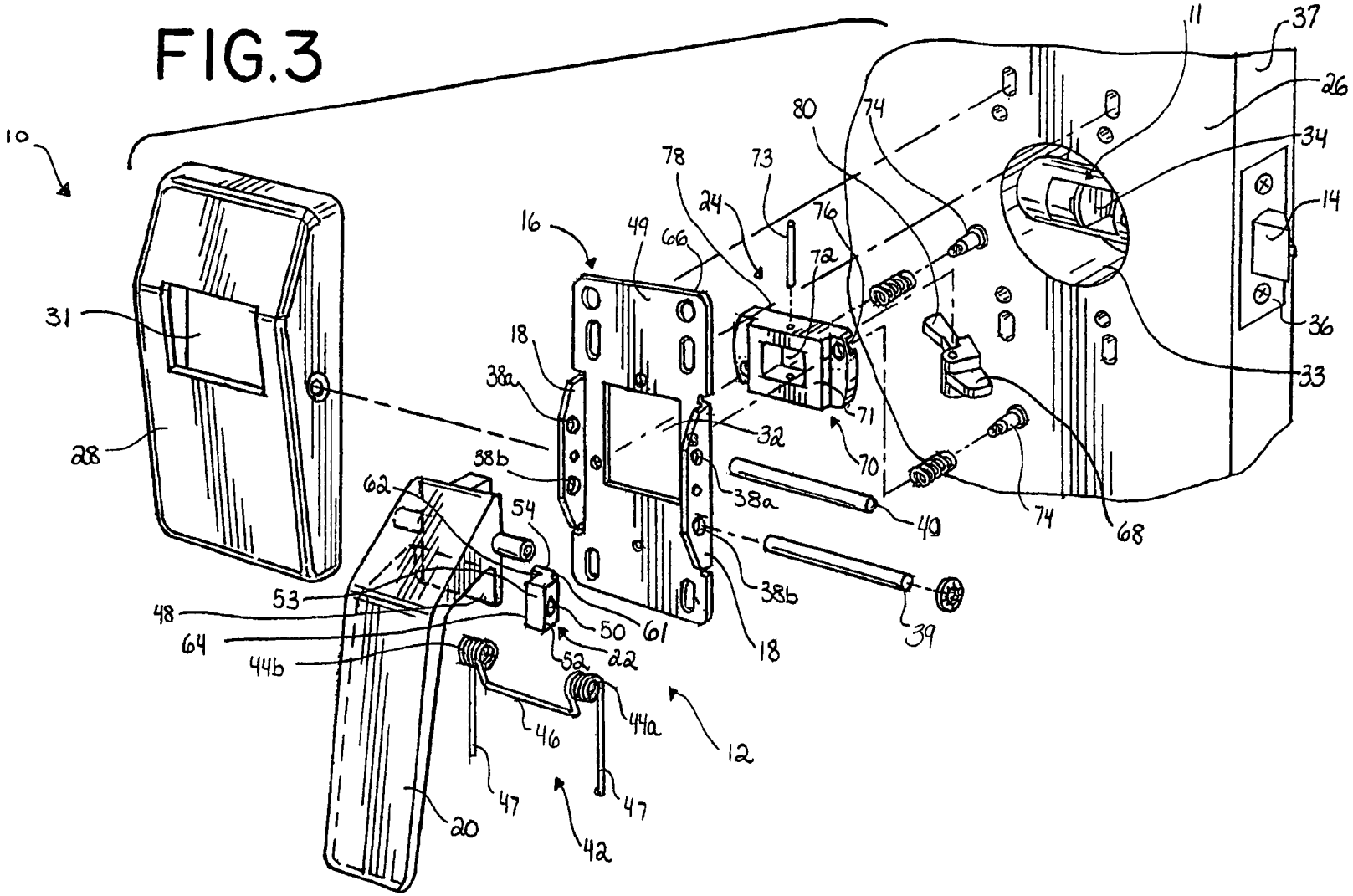
FIG. 3 is an exploded perspective view of FIG. 1.

Referring to FIGS. 1 and 3, the present push/pull door latch assembly is shown and generally designated 10. The assembly 10 generally includes a latch cylinder 11 and a handle assembly 12. The latch cylinder 11 includes a latch 14, and the handle assembly 12 includes a mounting plate 16 having a pair of sidewalls 18, a handle 20 secured between the sidewalls for a push or pull operation, a stop 22 configured for limiting the movement of the handle during the push or pull operation, and a cam assembly 24 operating in response to the push or pull operation, the cam assembly operating the latch so as to unlock the door when the handle is pushed or pulled.

As is generally known in the art, the assembly 10 is mounted to a door 26, and is configured for engaging the latch 14, which facilitates opening and closing of the door. As is also known in the art, the assembly 10 is generally covered by a faceplate 28 that is secured to the sidewalls 18 by at least one pair of faceplate screws 30. The faceplate 28 is preferably manufactured from stainless steel, although it is appreciated that other materials with similar properties are available, as are known in the art.

The use of the faceplate screws 30 enable easy assembly and disassembly of the faceplate 28 to and from the mounting plate 16. However, other means of attachment are available, such as a snap-fit or tongue-and-groove fit, as are known in the art.

The faceplate 28 includes a generally rectangular shaped opening 31 that is configured for receiving the handle 20, although it is appreciated that other shapes are available. The handle 20 is configured to be either a push or pull handle, depending on which side of the door 26 the assembly 10 is located and also on the needs of the application. The handle 20 is preferably manufactured by investment casting stainless steel, as is known in the art. However, other materials and methods of manufacture are also available.

Figure 4:
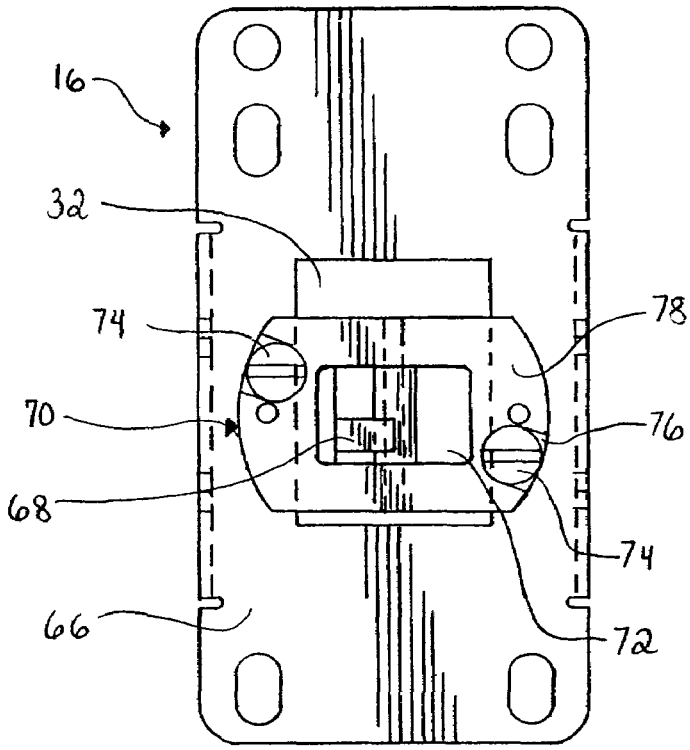
FIG. 4 is a front view of the cam assembly as it appears on the mounting plate of the assembly of FIG. 1.

Referring to FIGS. 3 and 4, the mounting plate 16 includes a generally rectangular centrally located opening 32 configured for alignment with a generally circular opening 33 in the door 26. The latch cylinder 11 is secured within the door opening 33, and has an opening 34 configured for general alignment with the mounting plate opening 32. In the present embodiment, the mounting plate 16 is manufactured from stainless steel, although it is appreciated that other similar materials are available, as are known in the art.

As is known in the art, a lock mortise 36 is installed in an opening in an edge 37 of the door 26 through which the latch 14 of the latch cylinder 11 protrudes to latch the door in a door jamb (not shown).

As seen in FIG. 3, each of the sidewalls 18 includes at least one pair of laterally aligned openings 38. In the present assembly 10, there are two pairs of laterally aligned openings 38*a* and 38*b*. In this embodiment, one pair of the openings 38*a* is configured for receiving a shaft 39, and the other pair of openings 38*b* is configured for receiving a pivot pin 40. However, it is appreciated that other arrangements and quantities of laterally aligned openings are available, depending on the needs of the application.

Referring to FIG. 3, the handle 20 is disposed between the sidewalls 18 by means of the pivot pin 40. In the present embodiment, the pivot pin 40 is manufactured from 6061-T6 Aluminum, as is known in the art. However, other materials with similar properties are available.

The pivot pin 40 allows for proper operation of the handle 20, and maintains alignment of the handle within the assembly 10. A torsion spring 42 is located on the pivot pin 40, and is configured for returning the handle 20 to its no-load or starting position when the handle is released, as is known in the art. The torsion spring 42 is generally U-shaped, with coiled spring-shaped side portions 44*a*, 44*b*, a horizontal bottom portion 46 and a pair of legs 47.

Each of the spring-shaped side portions 44*a*, 44*b* is configured for wrapping around the pivot pin 40, on opposite sides of the handle 20, respectively (see FIG. 3). The bottom portion 46 is located underneath and generally abuts a generally planar section 48 of the handle 20.

Figure 2:
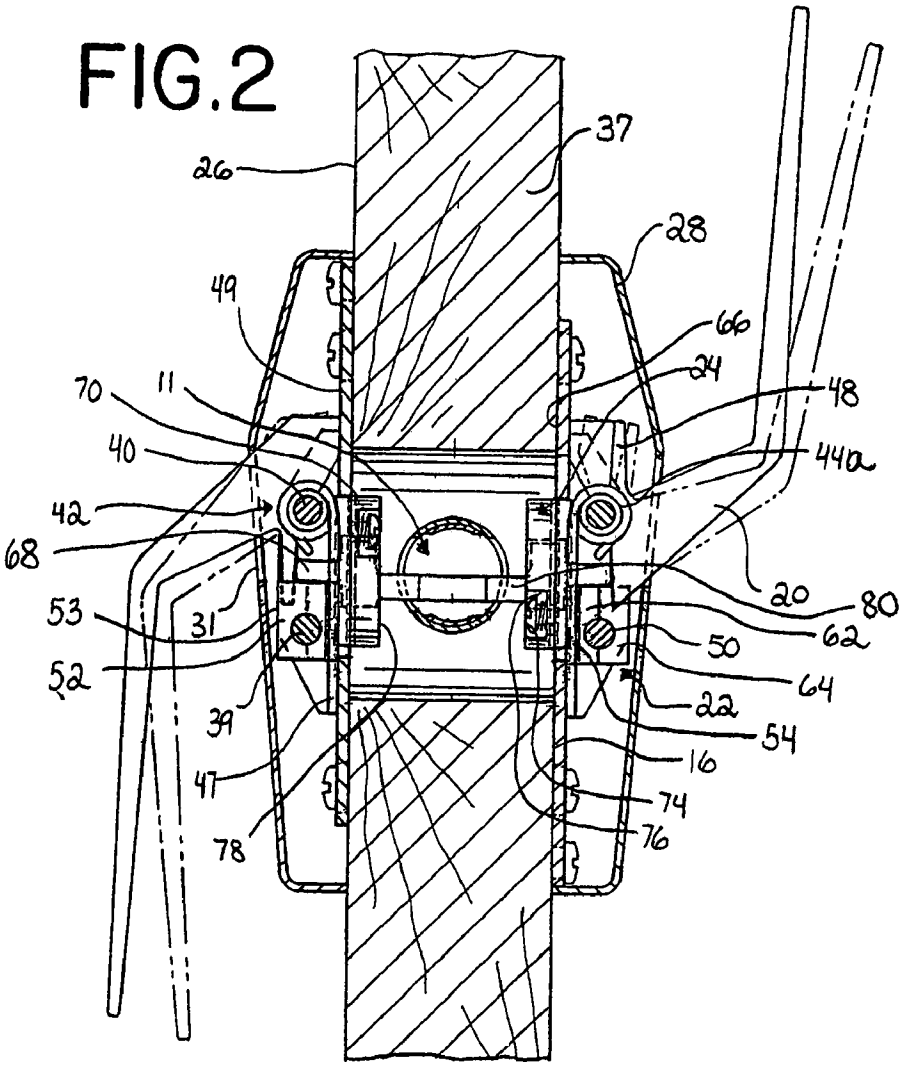
FIG. 2 is a fragmentary side view of the assembly of FIG. 1.

Each of the legs 47 lies parallel to a longitudinal axis of the mounting plate 16 and is configured to abut against a top side 49 of the mounting plate, adjacent to the sidewalls 18 (FIG. 2). In the present assembly 10, the torsion spring 42 is manufactured from stainless steel. However, it is appreciated that other materials with similar properties are available, as are known in the art.

Figure 5:
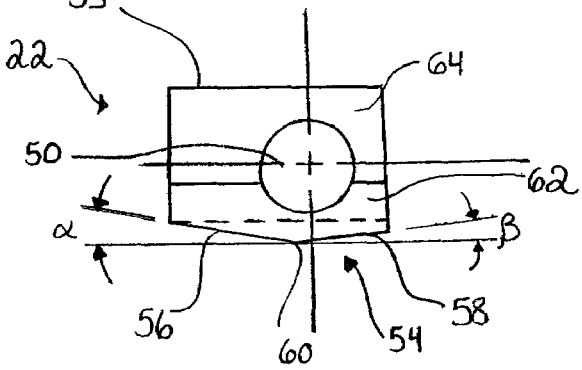
FIG. 5 is a side view of the stop of the assembly of FIG. 1.
Figure 6:
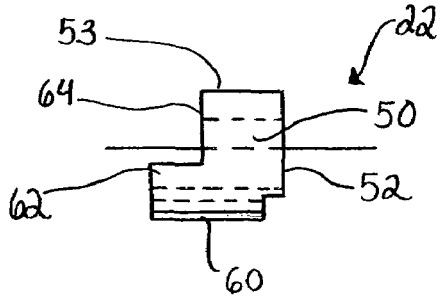
FIG. 6 is a top view of the stop of FIG. 5.

Referring to FIGS. 2, 3 and 5, the stop 22 includes a through-hole 50 configured to loosely receive the shaft 39. Preferably both the stop 22 and the shaft 39 are manufactured by investment casting stainless steel, or any other suitable method and material, as are known in the art. The stop 22 has a backside 52 configured for parallel arrangement with one of the sidewalls 18.

In the present embodiment, the backside 52 is not rigidly fixed or abutted against the sidewall 18. Rather, the stop 22 is loosely held between the sidewall 18 and the handle 20. A top 53 of the stop 22 is configured to exceed the height of the generally planar section 48 of the handle 20 in its starting position (FIG. 2). The stop 22 remains between the sidewall 18 and the handle 20 because of the higher clearance of the top 53. This arrangement prevents the stop 22 from moving underneath the generally planar section 48 and interfering with the operation of the handle 20.

The stop 22 further includes a bottom surface 54 having a first part 56 and a second part 58. The first and second parts 56, 58 are not parallel with the longitudinal axis of the mounting plate 16, but are instead disposed at angles relative to the longitudinal axis of the mounting plate. The angles can be measured from an apex 60, which is in contact with the mounting plate 16.

Referring to FIG. 5, in the present embodiment, the first part 56 is disposed at an angle $\alpha$ with respect to the longitudinal axis of the mounting plate 16. It is preferred that the angle $\alpha$ be approximately 10°, though other angle measurements are possible. The second part 58 is disposed at an angle $\beta$ with respect to the longitudinal axis of the mounting plate 16. In the present embodiment, the angle $\beta$ has a measurement of approximately 5°, although other measurements are available.

The angular configurations of the first part 56 and the second part 58 of the stop 22 (FIG. 5) aid in reducing the shock experienced by the handle 20, because the stop is not rigidly fixed on the shaft 39 and can toggle somewhat. It is contemplated that the toggling movement of the stop 22 reduces the shock on the handle 20 because unlike a rigidly fixed stop, which abruptly stops movement, the current stop will move with the handle and gradually stop its movement. It is also believed that this arrangement helps to increase the life of the handle.

As is seen in FIGS. 2 and 3, the stop 22 further includes a notch 61 configured for receiving one of the pair of legs 47 of the torsion spring 42 and a ledge 62 that extends outward from a front side 64 of the stop 22.

The generally planar section 48 of the handle 20 is configured for engaging the ledge 62 in operation. During handle operation, the handle 20 is either pushed or pulled, depending on the needs of the application. The generally planar section 48 of the handle 20 engages the ledge 62 of the stop 22, limiting the movement of the handle. By limiting the movement of the handle 20 during operation, the velocity at which the handle travels is also limited, which reduces the shock experienced by the handle.

Because the shock on the handle 20 is decreased in comparison to current assemblies, the wear on the handle is also reduced, and as a result, it is contemplated that the life of the handle and the assembly as a whole is increased.

Referring to FIGS. 3 and 4, the cam assembly 24 is preferably disposed on an underside 66 of the mounting plate 16, and is preferably aligned with the mounting plate opening 32. This arrangement allows the handle 20 to engage the cam assembly 24 during operation, which will be described in further detail below.

As is best seen in FIG. 3, the cam assembly 24 includes a cam 68, as is known in the art. The cam 68 is preferably manufactured from cold-rolled stainless steel, although it is appreciated that other materials and methods of manufacture are available. It is contemplated that the stainless steel cam 68 will absorb shock and last longer than cams that are manufactured from bronze or other relatively softer materials.

The cam assembly 24 further includes a screw plate 70 having a generally rectangular-shaped protruding section 71 configured for being received by the mounting plate opening 32. The protruding section 71 includes a generally centrally located opening 72 that is configured for alignment with the mounting plate opening 32 and the latch cylinder opening 34. The screw plate 70 is preferably manufactured by investment casting stainless steel or the like.

The cam 68 is pivotally attached within the centrally located opening 72 by a pivot pin rod 73, and is configured for engagement by the generally planar section 48 of the handle 20 during operation. The screw plate 70 is attached to the underside 66 of the mounting plate 16 by at least one pair of screw plate screws 74, each of which is located in a respective sunken portion 76 of the screw plate in an underside 78 of the screw plate (FIG. 2).

During operation of the assembly 10, the handle 20 is either pushed or pulled, depending on the needs of the application. When the handle 20 is in operation, the generally planar section 48 of the handle engages the cam 68, causing an elongate key 80 of the cam to enter the latch cylinder opening 34, engaging the latch 14 and moving it so that the door 26 can be opened.

When the generally planar section 48 engages the cam 68, it also engages the ledge 62 of the stop 22. It is contemplated that the ledge 62 limits the movement of the handle 20, reduces the shock experienced by the handle, and only permits the minimal amount of force necessary to engage the elongate key 80 of the cam 68 against the latch 14 of the latch cylinder 11. It is further contemplated that the angular arrangement of the first part 56 and the second part 58 of the stop 22 also aids in reducing shock on the handle 20 because of the toggling movement of the stop, described above.

The constant use of push/pull door assemblies in hospitals and other high-traffic areas generally cause the cam 68 to become worn down after repeated use. However, as described above, it is contemplated that in the present assembly 10, the wear on the cam 68 is reduced, thereby increasing its life.

While a particular embodiment of the low profile push/pull door latch apparatus has been described herein, it will be appreciated by those skilled in the art that changes and modifications may be made thereto without departing from the invention in its broader aspects and as set forth in the following claims.

The invention claimed is:

1. A push/pull door latch assembly for use in a door, comprising:

a handle assembly and a latch cylinder, wherein said latch cylinder has a latch, and wherein said handle assembly includes:

a mounting plate having a pair of sidewalls;

a handle secured between said sidewalls for a push or pull operation;

a stop movably secured between said mounting plate and said handle and configured for limiting the movement of said handle during the push or pull operation; and a cam assembly operating in response to the push or pull operation, said cam assembly operating said latch so as to unlock said door when said handle is pushed or pulled.

2. The push/pull door latch assembly of claim 1 comprising a shaft secured between said sidewalls, wherein said stop is located on said shaft.

3. The push/pull door latch assembly of claim 2, wherein said stop includes a through-hole configured to receive said shaft.

4. The push/pull door latch assembly of claim 1, wherein said stop includes a bottom surface having a first part and a second part.

5. The push/pull door latch assembly of claim 4, wherein said first part is disposed at a 10° angle with respect to a longitudinal axis of said mounting plate.

6. The push/pull door latch assembly of claim 4, wherein said second part is disposed at a 5° angle with respect to longitudinal axis of said mounting plate.

7. The push/pull door latch assembly of claim 1, wherein said stop further includes a ledge protruding from said stop.

8. The push/pull door latch assembly of claim 3, wherein said handle has a bottom generally planar section configured for engaging said ledge during handle operation.

9. The push/pull door latch assembly of claim 1, wherein said cam assembly is disposed on an underside of said mounting plate.

10. The push/pull door latch assembly of claim 1, wherein said handle is configured for engaging said cam assembly during operation.

11. The push/pull door latch assembly of claim 10, wherein said cam assembly includes a cam.

12. The push/pull door latch assembly of claim 11, wherein said cam assembly further includes a screw plate.

13. The push/pull door latch assembly of claim 12, wherein said screw plate is attached to said underside of said mounting plate by at least one pair of screws, each said screw having a circular head.

14. The push/pull door latch assembly of claim 1, wherein said mounting plate includes a central opening configured for alignment with an opening in said latch cylinder.

15. The push/pull door latch assembly of claim 1 comprising a shaft secured between said sidewalls, wherein said sidewalls each have at least one pair of laterally aligned openings.

16. The push/pull door latch assembly of claim 15, wherein one pair of said sidewall openings is configured to receive a pivot pin.

17. The push/pull door latch assembly of claim 16, wherein said handle is disposed between said sidewalls by means of said pivot pin.

18. The push/pull door latch assembly of claim 15, wherein said shaft is configured to be received by one pair of said laterally aligned openings.

19. A push/pull door latch assembly for use in a door, comprising:

a handle assembly and a latch cylinder, wherein said latch cylinder has a latch, and wherein said handle assembly includes:

a mounting plate having a pair of sidewalls;

a handle secured between said sidewalls for a push or pull operation;

a stop having an angled bottom surface configured for toggling with respect to said mounting plate and limiting the movement of said handle during the push or pull operation; and a cam assembly operating in response to the push or pull operation, said cam assembly operating said latch so as to unlock said door when said handle is pushed or pulled.

20. A push/pull door latch assembly for use in a door, comprising:

a handle assembly and a latch cylinder, wherein said latch cylinder has a latch, and wherein said handle assembly includes:

a mounting plate having a pair of sidewalls;

a handle secured between said sidewalls for a push or pull operation;

a stop movably secured between said mounting plate and said handle and having a backside arranged adjacent to one of said sidewalls and a front side and being configured for limiting the movement of said handle during the push or pull operation, said stop including a ledge portion protruding from said front side; and a cam assembly operating in response to the push or pull operation, said cam assembly operating said latch so as to unlock said door when said handle is pushed or pulled.

* * * * *